US010271592B2

(12) United States Patent
Carbo, Jr. et al.

(10) Patent No.: US 10,271,592 B2
(45) Date of Patent: Apr. 30, 2019

(54) MONOLITHIC PROTECTIVE ARTICLE WITH FLEXIBLE REGION

(71) Applicant: NIKE, Inc., Beaverton, OR (US)

(72) Inventors: Jorge E. Carbo, Jr., Aloha, OR (US); Nathan Demarest, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 504 days.

(21) Appl. No.: 14/207,019

(22) Filed: Mar. 12, 2014

(65) Prior Publication Data

US 2014/0259330 A1 Sep. 18, 2014

Related U.S. Application Data

(60) Provisional application No. 61/780,018, filed on Mar. 13, 2013.

(51) Int. Cl.
*A41D 13/05* (2006.01)
*A41D 13/015* (2006.01)
(Continued)

(52) U.S. Cl.
CPC ..... *A41D 13/05* (2013.01); *A41D 13/015* (2013.01); *A63B 71/12* (2013.01);
(Continued)

(58) Field of Classification Search
CPC .... A41D 13/015; A41D 13/065; A41D 13/05; A41D 13/0512; A41D 13/018;
(Continued)

(56) References Cited

U.S. PATENT DOCUMENTS 3,210,781 A * 10/1965 Pollock ..... A47C 27/001 267/91
4,190,697 A * 2/1980 Ahrens ..... B29C 44/0461 428/309.9
4,479,269 A * 10/1984 Balliet ..... A41D 31/0044 2/23
(Continued)

OTHER PUBLICATIONS

International Search Report with Written Opinion dated Aug. 11, 2014 in Application No. PCT/US2014/025255, 11 pages.
(Continued)

*Primary Examiner* — Megan Lynch
*Assistant Examiner* — Catherine M Ferreira
(74) *Attorney, Agent, or Firm* — Shook, Hardy & Bacon L.L.P.

(57) ABSTRACT

An article of protective equipment includes a one-piece body. The body includes a first region, an edge, and a second region. The first region is formed from a first composite material having a first matrix component and a first reinforcement component. The second region extends between the first region and the edge. The second region is formed from a second composite material having a second matrix material and a second reinforcement component. One of the first reinforcement component and the second reinforcement component has a plurality of first items arranged randomly. The other of the first reinforcement component and the second reinforcement component has a plurality of second items arranged in a predetermined arrangement. The body is configured to protect the wearer from an input load, and the second region is configured to flex under the influence of the input load.

14 Claims, 11 Drawing Sheets

(51) Int. Cl.

| | |
|---|---|
| ***A63B 71/12*** | (2006.01) |
| *A41D 31/00* | (2019.01) |
| *A63B 71/08* | (2006.01) |

(52) U.S. Cl.

CPC ..... *A63B 71/1225* (2013.01); *A41D 13/0543* (2013.01); *A41D 31/0044* (2013.01); *A63B 71/081* (2013.01); *A63B 2071/125* (2013.01); *A63B 2071/1241* (2013.01); *A63B 2071/1258* (2013.01); *A63B 2209/02* (2013.01)

(58) Field of Classification Search

CPC ..... A41D 13/0156; A41D 13/0155; A41D 13/0543; A41D 13/0002; A41D 13/0506; A41D 13/06; A41D 13/08; A41D 13/0153; A41D 2600/102; A41D 31/0027; A41D 1/04; A41D 1/06; A41D 13/0012; A41D 1/08; A41D 2600/10; A41D 3/00; A41D 13/0007; A41D 13/02; A41D 13/0537; A63B 71/12; A63B 71/1225

USPC ..... 2/455, 267, 161.1, 160, 22, 23, 24, 410

See application file for complete search history.

(56) References Cited

U.S. PATENT DOCUMENTS

| | | | | |
|---|---|---|---|---|
| 4,513,449 | A | 4/1985 | Donzis | |
| 5,609,707 | A * | 3/1997 | Bazshushtari | D04H 1/46 156/148 |
| 6,070,273 | A * | 6/2000 | Sgro | A41D 13/0153 2/231 |
| 7,415,733 | B2 * | 8/2008 | Rampersad | A41D 13/0556 2/23 |
| D656,278 | S * | 3/2012 | Saranga | D29/121.1 |
| 8,132,269 | B1 * | 3/2012 | Ibon | A41D 19/01523 2/161.1 |
| 9,352,531 | B2 * | 5/2016 | Berns | A41D 13/0506 |
| 2011/0035864 | A1 * | 2/2011 | Gordon | A41D 13/05 2/455 |
| 2014/0004322 | A1 * | 1/2014 | Kim | B32B 5/02 428/201 |

OTHER PUBLICATIONS

International Preliminary Report on Patentability dated Sep. 24, 2015 in Application No. PCT/US2014/025255, 9 pages.

* cited by examiner

MONOLITHIC PROTECTIVE ARTICLE WITH FLEXIBLE REGION

CROSS-REFERENCE TO RELATED APPLICATION(S)

This application claims the benefit of U.S. Provisional Patent Application No. 61/780,018, filed on Mar. 13, 2013, the disclosure of which is incorporated by reference in its entirety.

BACKGROUND

Various types of equipment are configured to protect the wearer's body. For instance, thigh guards are provided for protecting the wearer's thighs, shin guards are provided for protecting the wearer's shin, rib guards are provided for protecting the wearer's ribs, knee pads are provided for protecting the wearer's knees, and more. This equipment can be intended for use during sporting or other activities.

In many cases, the equipment can include relatively stiff and strong members, such as rigid plates. When impacted, the member can distribute the impact load. Thus, if worn during a sporting activity, the wearer may get hit by another player, by a ball, or other object. However, the protective article can shield the wearer's body from impact and distribute the impact load across the wearer's body. Accordingly, the protective article can protect the wearer during such activities.

SUMMARY

An article of protective equipment is disclosed. The article can include a one-piece, monolithic body that can protect the wearer. The body can include two or more regions that differ in flexibility and stiffness characteristics. For example, one region proximate an edge of the body can be more flexible than a central region of the body. Thus, when the body is impacted, the edge can flex relative to the central region, and the edge is unlikely to press into the wearer. Stated differently, concentrations of force against the wearer's body are unlikely to occur from the edge of the body.

In some embodiments, the second, flexible region can define a so-called "living hinge" of the body. Also, in some embodiments, the monolithic body can include composite materials. The components of these materials can be arranged within the different zones to provide the different flexibilities of the regions. For example, reinforcing items within the composite material of one zone can be arranged randomly, whereas reinforcing items within the composite material of another zone can be arranged in a predetermined manner. Additionally, in some embodiments, the thickness of the body can be substantially constant. However, in other embodiments, the thickness of the body can vary to provide the desired flexibility to the different regions. Moreover, manufacturing methods are discussed for providing the different flexibilities for these different regions.

More specifically, an article of protective equipment is disclosed according to some embodiments. The article is configured to protect a wearer. The article includes a one-piece body. The body includes a first region, an edge, and a second region. The first region is formed from a first composite material having a first matrix component and a first reinforcement component. The second region extends between the first region and the edge. The second region is formed from a second composite material having a second matrix material and a second reinforcement component. One of the first reinforcement component and the second reinforcement component has a plurality of first items arranged randomly. The other of the first reinforcement component and the second reinforcement component has a plurality of second items arranged in a predetermined arrangement. The body is configured to protect the wearer from an input load, and the second region is configured to flex under the influence of the input load to allow the edge to move relative to the first region.

A method of manufacturing an article of protective equipment is also disclosed. The method includes providing a first composite material having a first matrix component and plurality of first items. The method also includes providing a second composite material having a second matrix component and a plurality of second items. Moreover, the method includes forming a one-piece body having a first region, an edge, and a second region. The second region extends between the first region and the edge. One of the first region and the second region is formed from the first composite material and has the plurality of first items arranged randomly. The other of the first region and the second region is formed from the second composite material and has the plurality of second items arranged in a predetermined arrangement. The body is configured to protect the wearer from an input load, and the second region is configured to flex under the influence of the input load to allow the edge to move relative to the first region.

Furthermore, an article of protective equipment is disclosed. The article is configured to protect a wearer. The article includes a support structure configured to secure to the wearer. The article also includes a body that is supported by the support structure. The body is monolithic. Also, the body includes a first region formed from a first composite material having a first matrix component and a first reinforcement component. The one-piece body also includes an edge and a second region. The second region extends between the first region and the edge. The second region is formed from a second composite material having a second matrix component and a second reinforcement component. The first reinforcement component has a plurality of particles arranged randomly. The second reinforcement component has a plurality of fibers arranged in a substantially uniform direction. The body is configured to protect the wearer from an input load, and the second region is configured to flex under the influence of the input load to allow the edge to move relative to the first region.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
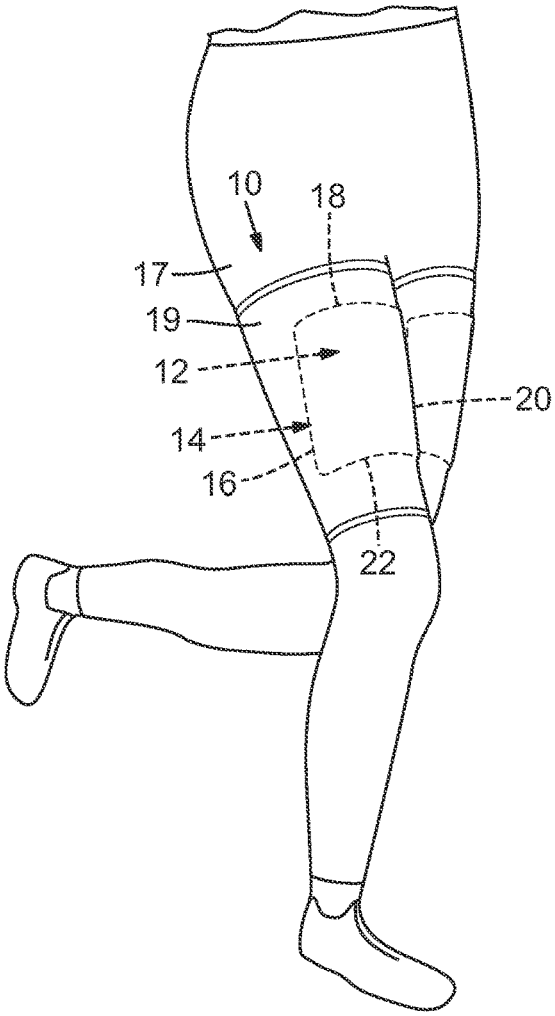
FIG. 1 is a perspective view of an article of protective equipment according to exemplary embodiments of the present disclosure, wherein the article is shown being worn by a wearer.
Figure 2:
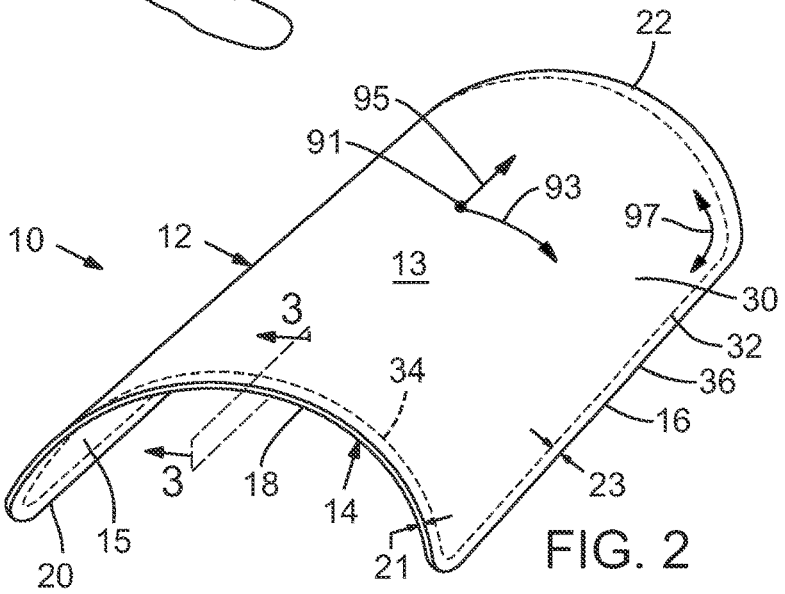
FIG. 2 is a perspective view of a protective body of the article of protective equipment of FIG. 1.

Referring initially to FIGS. 1 and 2, an article of protective equipment 10 is illustrated according to exemplary embodiments of the present disclosure. As will be discussed, the article 10 can protect a wearer 17 against external forces, such a force from an object that hits the wearer 17. The article 10 can generally include a support structure 19 and at least one protective body 12. The protective body 12 is shown independently without the support structure 19 in FIG. 2. The protective body 12 can be substantially rigid and strong for protecting the wearer 17. The support structure 19 can support the body 12 and secure the body 12 to the wearer 17.

The article 10 can have any suitable shape and construction for being worn on a wearer's body. For example, in the embodiment of FIG. 1, the article 10 is a thigh guard that is worn proximate the thigh area of the wearer 17. It will be appreciated, however, that the article 10 can be a shin guard, an elbow guard, or any other type of protective article. The article 10 can also be worn during athletic activities in some embodiments. As such, the article 10 can protect the wearer's body if it impacts another player, a ball, or other object.

Generally, the protective body 12 can have a single-body construction in some embodiments. Stated differently, the protective body 12 can be monolithic and unitarily constructed. As such, the protective body 12 can provide desirable strength, rigidity, durability, and other characteristics that aid in protecting the wearer 17. Moreover, the body 12 can be relatively lightweight, and the body 12 can be shaped to closely conform to the wearer's body. Accordingly, the article 10 can be more comfortable and effective during athletic and other activities. Also, the construction of the body 12 can reduce the part count of the article 10. Moreover, the body 12 can be manufactured in a relatively short amount of time. Thus, the body 12 can provide significant manufacturing efficiencies.

Moreover, the protective body 12 can include two or more integrally attached regions or zones that have different characteristics. In some embodiments, these differences can enhance the ability of the body 12 to protect the wearer 17.

For example, in some embodiments, the body 12 can include two or more integrally attached regions that differ in mechanical properties, such as stiffness, rigidity, flexibility, flexural modulus, modulus of elasticity, strength, and/or in other ways. These differences can be achieved by forming the regions from different materials. These differences can also be achieved by forming the regions with different thicknesses, different surface contours, and/or other structural differences.

In some embodiments, a more rigid region of the body 12 can be impacted and can distribute the impact load across the wearer's body while a more flexible region of the body 12 can flex due to the impact load. As such, the body 12 can protect the wearer by distributing impact loads across the wearer's body and reducing concentrations of load on the wearer. Also, the more flexible regions can flex to further reduce concentrations of load on the wearer.

Accordingly, the body 12 can have an advantageous one-piece construction. However, different regions of the body 12 can be provided with different mechanical properties such that the one-piece body 12 can be more comfortable, lightweight, and/or effective in protecting the wearer.

The embodiment of FIG. 1 will now be discussed in greater detail. As shown, the support structure 19 can be a wrap that wraps around the leg or other body part of the wearer 17. In some embodiments, the support structure 19 can include a pocket that receives the body 12 as shown in FIG. 1. Accordingly, the body 12 can be positioned and secured over a predetermined area of the wearer's body. In other embodiments, such as the embodiment of FIG. 6, the support structure 19 can include a strap, laces, a belt, or other object that wraps around the wearer's body to secure the body 12 over the intended body part. It will be appreciated that the support structure 19 can include other structures, such as buckles, fasteners, hook-and-loop tape, or other members that releasably secure the article 10 to the wearer's body.

Additionally, in some embodiments, the article 10 can also include other members. For example, the article 10 can include added padding, foam, a fluid-filled bladder, or other cushioning material for attenuating impact loads.

The protective body 12 will now be discussed in greater detail with reference to FIG. 2. In some embodiments, the body 12 can be relatively thin and plate-like. The body 12 can be a monolithic, unitarily constructed, one-piece body. The body 12 can also be relatively rigid and strong so as to withstand impact and to protect the wearer.

The body 12 can include an outer surface 13 and an inner surface 15. The outer surface 13 and the inner surface 15 can face away from each other. When worn, the inner surface 15 can face the wearer 17, and the outer surface 13 can face away from the wearer 17 as shown in FIG. 1.

The outer surface 13 and inner surface 15 can be relatively smooth and continuous in some embodiments. In additional embodiments, the outer surface 13 and/or the inner surface 15 can include one or more holes, grooves, channels, notches, recesses, ribs, and the like.

Moreover, the body 12 can include an edge 14. The edge 14 can define the periphery (i.e., outer perimeter) of the body 12. As such, the edge 14 can be an exterior edge of the body 12. However, the edge 14 could also be an interior edge of the body 12. For example, the edge 14 could be an inner surface or inner diameter of a through-hole or other opening in the body 12. The edge 14 can also be another surface of body 12 where the body 12 terminates. Also, the edge 14 can be disposed at any suitable angle with respect to the outer surface 13 and the inner surface 15. For example, the edge 14 can be disposed substantially perpendicular with respect to the outer surface 13 and inner surface 15. In other embodiments, the edge 14 can be rounded convexly or concavely between the outer surface 13 and the inner surface 15.

The edge 14 can comprise one or more curved or straight portions. As shown in FIG. 2, for example, a first portion 16, a second portion 18, a third portion 20, and a fourth portion 22 can cooperate to define the edge 14 of the body 12. As shown in FIG. 1, when the body 12 is worn, the second portion 18 of the edge 14 can face upward, the fourth portion 22 of edge 14 can face downward, and the first portion 16 and the third portion 20 can extend along the longitudinal axis of the wearer's leg. As shown in FIG. 2, the first portion 16 and the third portion 20 can be substantially straight and linear. In contrast, in some embodiments, the second portion 18 and the fourth portion 22 can be curved. Thus, the outer surface 13 and the inner surface 15 can curve or bow. Thus, the shape and size of the body 12 can correspond to the shape and surface curvature of the wearer's leg, and the size of the body 12 can correspond to the area of the leg needing protection. However, it will be appreciated that the shape and size of the body 12 can be different from the embodiment of FIG. 2 and can be selected to fit and conform to another area of the wearer's body.

The body 12 and the edge 14 can also define one or more directions that will be used for purposes of reference during the following discussion. For example, as shown in FIG. 2, the body 12 can define an inboard-outboard direction, which is represented with an arrow 93. As shown, the arrow 93 extends from a center 91 of the body 12, and the arrow 93 points to the first portion 16 of the edge 14. Another arrow 95 is directed in the inboard-outboard direction from the center 91 to the fourth portion 22 of the edge 14. Moreover, the body 12 can define a peripheral direction that is indicated with double-headed arrow 97. As shown, the peripheral direction extends along the periphery of the body 12 and along the edge 14.

The body 12 can have any suitable thickness 21. The thickness 21 can be measured between the outer surface 13 and the inner surface 15. In some embodiments, the thickness 21 of the body 12 can be substantially constant across the body 12 in the inboard-outboard direction as well as the peripheral direction. In other embodiments, the thickness 21 can vary across the body 12. Also, in some embodiments, the thickness 21 of the body 12 can be substantially constant in the inboard-outboard direction within a distance of approximately 1.5 inches from the edge 14. Also, in some embodiments, the thickness 21 of the body can be substantially constant in the peripheral direction along the edge 14. Accordingly, in some embodiments, the thickness 21 of the body 12 can be substantially constant proximate the edge 14.

Moreover, the body 12 can be made from any suitable material. In some embodiments, the body 12 can be at least partially made from composite materials as will be discussed in greater detail below.

As mentioned above, the body 12 can include two or more regions that have different characteristics. For example, in some embodiments, the body 12 can have two or more areas that differ in flexibility, flexural modulus, modulus of elasticity, stiffness, rigidity, and/or materials. More specifically, the body 12 can include a first region 30 and a second region 32 that can differ in these ways. The first and second regions 30, 32 can be disposed in any suitable location on the body 12 relative to each other. For example, in the embodiment of FIG. 2, the first region 30 can be centrally located on the body 12, and the second region 32 can be disposed adjacent the edge 14 of the body 12 as indicated by broken line 34.

Figure 4:
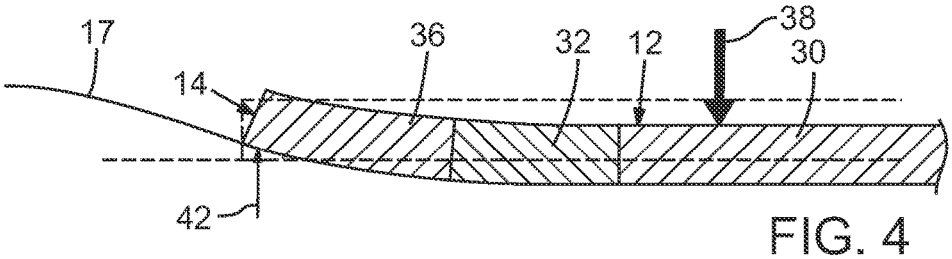
FIG. 4 is a section view of the protective body of FIG. 2 shown flexing under the influence of an external load according to exemplary embodiments.
Figure 5:
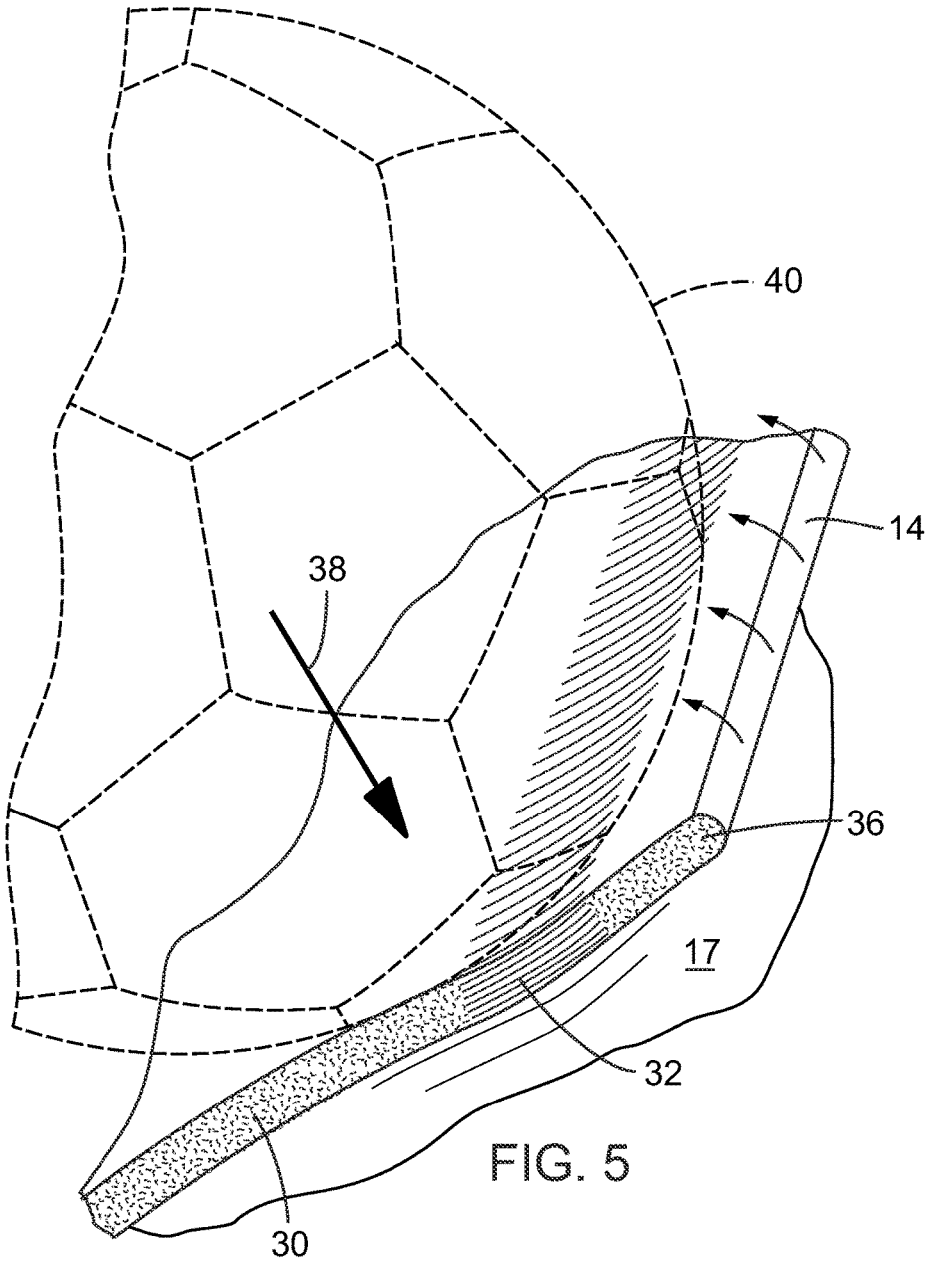
FIG. 5 is a perspective view of the protective body of FIG. 2 shown flexing under the influence of an external load according to exemplary embodiments.

In some embodiments, the second region 32 can be more flexible than the first region 30 and can have a lower flexural modulus than the first region 30. Stated differently, the first region 30 can be stiffer than the second region 32. Thus, when the body 12 is impacted as represented in FIGS. 4 and 5, the second region 32 can resiliently and elastically deform more than the first region 30. Thus, in some embodiments, the body 12 can resiliently deform proximate the edge 14 more than the first region 30 due to flexure of the second region 32. Accordingly, the edge 14 is unlikely to cause stress concentrations on the wearer's body when the body 12 is impacted. Stated differently, the edge 14 is unlikely to dig into the wearer's body and cause discomfort.

Embodiments of the body 12 will now be discussed in greater detail in relation to FIGS. 2 and 3. As shown in FIG. 2, the body 12 can include the first region 30 and the second region 32. The first region 30 can define the central region and the majority of the body 12 in some embodiments. Also, the second region 32 can be disposed proximate the edge 14. In some embodiments, the second region 32 can be spaced from the edge 14 in the inboard direction by a distance 23.

The distance 23 between the edge 14 and the second region 32 can be substantially constant in the peripheral direction 97 along the edge 14. In other embodiments, the distance 23 can vary along the edge 14 in the peripheral direction 97. The distance 23 can be less than two inches in some embodiments. Also, in some embodiments, the distance 23 can be less than one inch. In other embodiments, the second region 32 can extend all the way to the edge 14 in the outboard direction. Stated differently, in some embodiments, the second region 32 can define the edge 14.

Additionally, the second region 32 can encompass the first region 30 in some embodiments. Moreover, the second region 32 can extend continuously and uninterrupted along the edge 14 of the body 12. It will be appreciated, however, that the second region 32 can be discontinuous in some embodiments.

Figure 3:
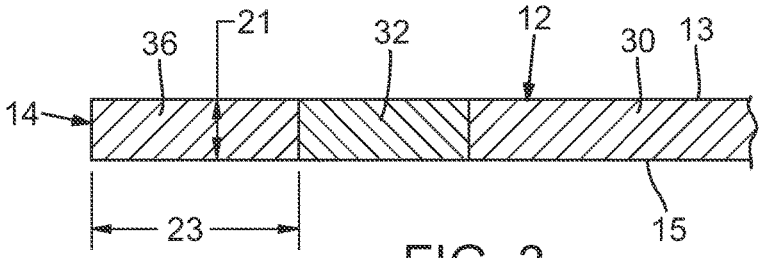
FIG. 3 is section view of the protective body taken along the plane 3-3 of FIG. 2.

Moreover, as shown in FIG. 3, the first region 30 and the second region 32 can cooperate to define the outer surface 13 and the inner surface 15 of the body 12. This is indicated using different cross-hatching in FIG. 3 for the first region 30 and the second region 32.

The body 12 can additionally include a third region 36. As mentioned above, the first region 30 can be disposed centrally and can define a majority of the body 12, whereas the second region 32 can continuously encompass or border the first region 30. The third region 36 can define the edge 14 of the body 12 some embodiments. Thus, the second region 32 can be disposed between the first region 30 and the third region 36 in the inboard-outboard direction as shown in FIG. 3. However, it will be appreciated that body 12 may not, in some embodiments, include the third region 36. For instance, the second region 32 can extend in the outboard direction from the first region 30 and can define the edge 14. Thus, the second region 32 can be disposed between the edge 14 and the first region 36.

As mentioned above, the second region 32 can be more flexible than the first region 30. Also, the second region 32 can be more flexible than the third region 36. As such, the second region 32 can be configured as a hinge (e.g., a so-called "living hinge") for allowing rotation of the edge 14 relative to the first region 30 due to impact of the body 12.

The body 12 is shown in FIGS. 4 and 5 according to some embodiments in which an object impacts the body 12. In FIG. 5, the object is a ball 40 that is impacting the body 12. In FIGS. 4 and 5, the impact force or energy from the ball 40 is represented by arrow 38, and the body 12 is shown in a resulting flexed position against the body of the wearer 17. For purposes of comparison, the neutral, unloaded position of the body 12 is shown with broken lines in FIG. 4.

When impacted, some areas of the body 12 can remain substantially rigid or can flex a relatively small amount for protecting the wearer 17. Also, the body 12 can be driven toward the wearer 17 as indicated in FIG. 4. As a result, the body 12 can press into the wearer 17 and can deform the skin, muscle, and other tissue of the wearer 17. However, because of the flexibility of the second region 32, the tissue of the wearer 17 can push the third region 36 outward as indicated by arrow 42 in FIG. 4 and rotate the third region 36 and the edge 14 outward relative to the first region 30. Stated differently, the second region 32 can flex and bend such that third region 36 moves outward. Accordingly, stress and other loads are unlikely to concentrate along the edge 14 and cause discomfort for the wearer 17.

Thus, the body 12 can be a single-piece body. However, certain regions can be relatively stiff while other regions can flex to avoid stress concentrations against the wearer's body.

Figure 6:
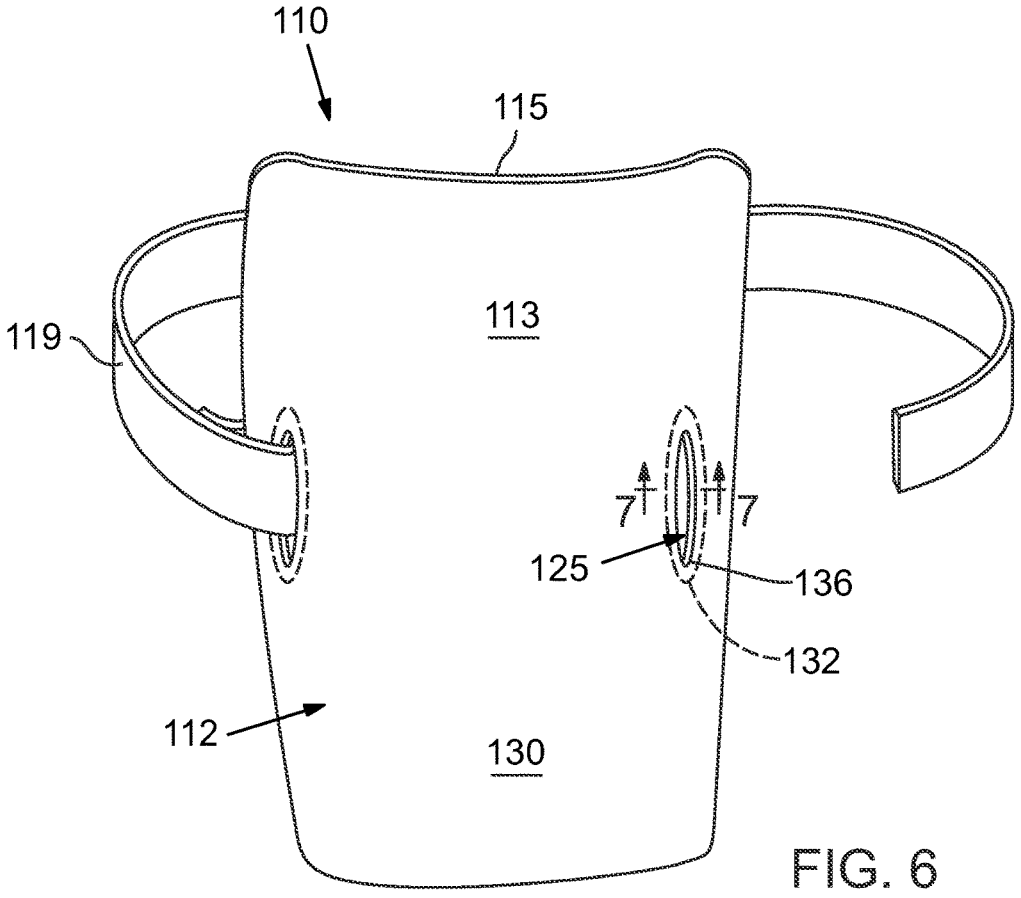
FIG. 6 is a front view of the article of protective equipment according to additional embodiments of the present disclosure.
Figure 7:
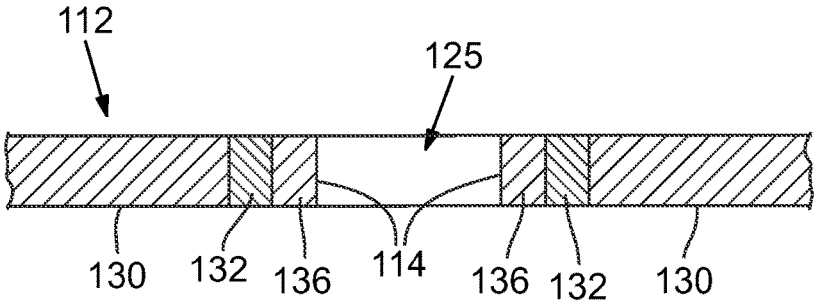
FIG. 7 is a section view of the protective body of the article of protective equipment taken along the line 7-7 of FIG. 6.

Referring now to FIGS. 6 and 7, additional embodiments of the article of protective equipment 110 are illustrated according to additional embodiments of the present disclosure. Components that correspond to the embodiments of FIGS. 1-5 are indicated with corresponding reference numbers increased by 100.

As shown, the support structure 119 of the article 110 can be a strap, webbing, a belt, or other elongate member that can wrap around a leg, a chest, an arm, or other part of the wearer's body. Also, the protective body 112 can include one or more openings 125. The opening 125 can be a through-hole extending between and through the outer surface 113 and the inner surface 115. In some embodiments, the opening 125 can be an elongate opening, such as a slot or ovate hole. However, it will be appreciated that the opening 125 can have any suitable shape. Also, although FIG. 6 shows only two openings 125, it will be appreciated that the body 112 can include less than or more than two openings 125.

In some embodiments, the opening 125 can receive the support structure 119 for securing the support structure 119 to the body 112. In other embodiments, the opening 125 can receive a fastener, a pad, or other object.

As shown in FIGS. 6 and 7, the inner diameter surface of the opening 125 can define the edge 114. Stated differently, the edge 114 can be an internal edge of the body 112.

Also, as shown in FIG. 7, the body 112 can include the first region 130, the second region 132, and the third region 136. These regions can differ in flexibility, stiffness, or other characteristic as described above with respect to the embodiments of FIGS. 1-5. In some embodiments, the first region 130 can define the majority of the body 112, and the second region 132 can encompass the opening 125. In FIG. 6, the second region 132 is represented with a broken line that encompasses the opening 125. Moreover, the third region 136 can define the edge 114.

When the body 112 is impacted, the body 112 can react similar to the embodiments discussed above with respect to FIGS. 4 and 5. Thus, the body 112 can be driven into the wearer's body. However, the second regions 132 can flex such that edge 114 can move away from the wearer's body. Thus, the internal edge 114 defining the opening 125 can flex to reduce stress concentrations on the wearer's body. It will be appreciated that the external, peripheral edge of the body 112 can be configured to flex as well, similar to the embodiments of FIGS. 1-5.

Figure 8:
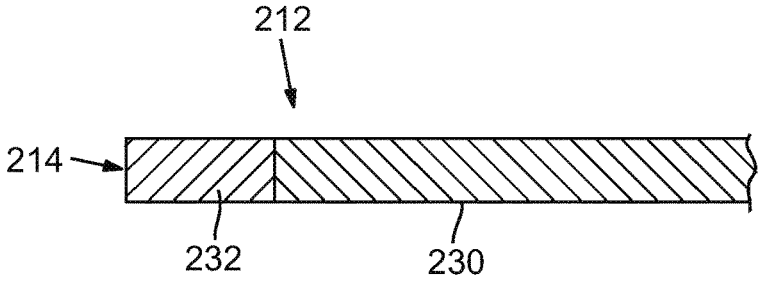
FIG. 8 is a section view of the protective body according to additional embodiments of the present disclosure.
Figure 9:
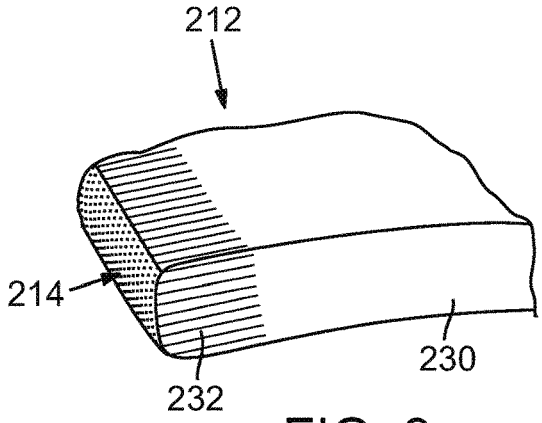
FIG. 9 is a perspective view of an area of the protective body of FIG. 8 that includes an edge.

Referring now to FIGS. 8 and 9, the protective body 212 is illustrated according to additional embodiments. Components that correspond to the embodiments of FIGS. 1-5 are indicated with corresponding reference numbers increased by 200.

The body 212 can be substantially similar to the body 12 of FIGS. 1-5. However, the second zone 232 can define the edge 214 of the body 212. The edge 214 can be the external, peripheral edge of the body 212 in some embodiments. In additional embodiments, the edge 214 can be an internal edge that defines a through-hole or other similar feature.

It will be appreciated that the different regions of the body can be provided with different flexibilities in various ways. For instance, the materials and/or manufacturing methods used to form the regions can be selected to achieve the different flexibilities. Also, the body can include one or more structural features, such as grooves, channels, recesses, reduced thickness, or other features that cause one region to be more flexible another.

Figure 10:
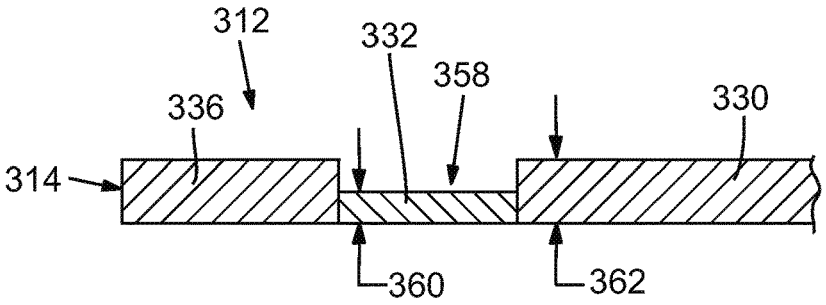
FIG. 10 is a section view of the protective body according to additional embodiments of the present disclosure.

For example, FIG. 10 illustrates an embodiment of the body 312 having a structural feature that increases flexibility at a predetermined region. Components that correspond to those of the embodiments of FIGS. 1-5 are indicated with corresponding reference numbers increased by 300.

The body 312 can include the first region 330, the second region 332, and the third region 336, similar to the embodiments of FIGS. 1-5. However, the second region 332 can include a thinned area 358, such as a channel, groove, recess, pit, and the like. Thus, the thickness 360 of the second region 332 can be less than the thickness 362 of the first region 330 and/or the third region 336. Accordingly, the reduced thickness of the second region 332 can increase flexibility of the second region 332. Also, in some embodiments, the thinned area 358 can be recessed from the outer surface of the body 312, and the inner surface can be relatively smooth. As such, the inner surface can lie substantially flat against the wearer for added comfort.

FIGS. 11-18 illustrate more embodiments in which the thickness of the protective body is varied to effect flexibility proximate an edge of the body. In FIGS. 11-18, components that correspond to the embodiments of FIGS. 1-5 are identified with corresponding reference numbers increased by increments of 100.

Figure 11:
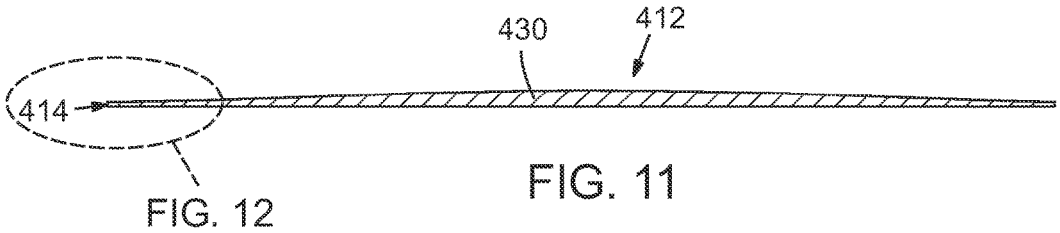
FIG. 11 is a section view of the protective body according to additional embodiments of the present disclosure.
Figure 12:
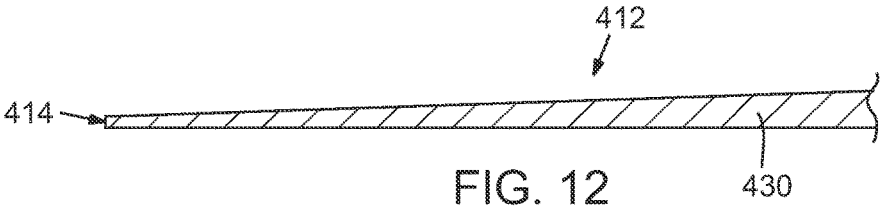
FIG. 12 is a section view of an area of the protective body of FIG. 11 that includes an edge.

For example, as shown in the embodiments of FIGS. 11-12, the body 412 can taper down gradually in thickness from the first region 430 to the edge 414. Thus, the body 412 can be more flexible adjacent the edge 414 than the more central areas of the body 412.

Figure 13:
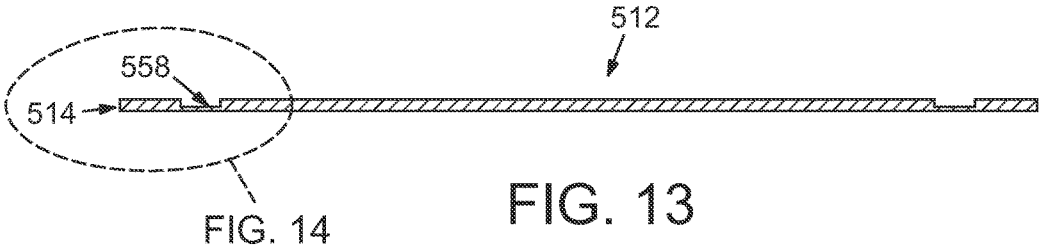
FIG. 13 is a section view of the protective body according to additional embodiments of the present disclosure.
Figure 14:
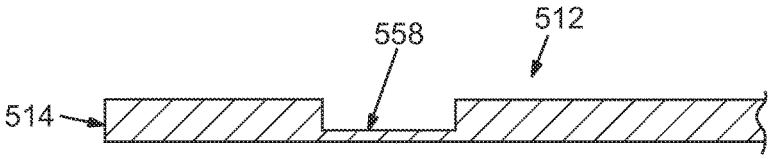
FIG. 14 is a section view of an area of the protective body of FIG. 13 that includes an edge.
Figure 15:
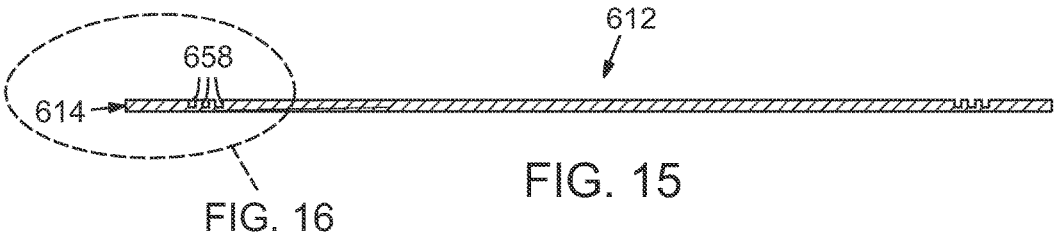
FIG. 15 is a section view of the protective body according to additional embodiments of the present disclosure.
Figure 16:
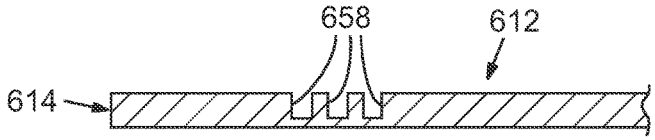
FIG. 16 is a section view of an area of the protective body of FIG. 15 that includes an edge.

Furthermore, as shown in the embodiments of FIGS. 13 and 14, the body 512 can include the thinned area 558 similar to the embodiments of FIG. 10. Similarly, as shown in the embodiments of FIGS. 15 and 16, the body 612 can include a plurality of thinned areas 658. There can be any suitable number of thinned areas 658, and the thinned areas 658 can have any suitable shape. For example, as shown in FIG. 16, the body 612 can include a series of three thinned areas 658 spaced away from each other and spaced in an inboard direction from the edge 614.

Figure 17:
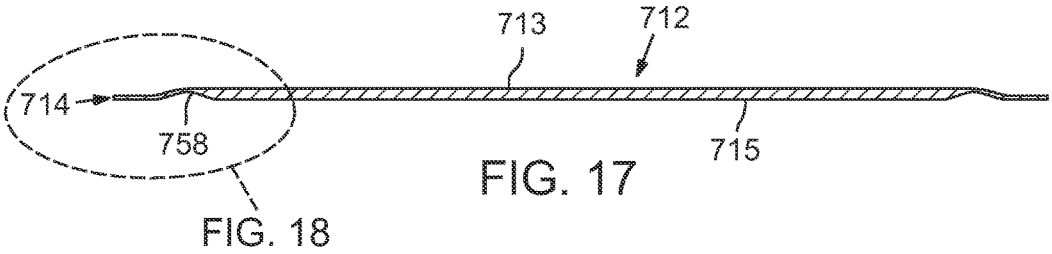
FIG. 17 is a section view of the protective body according to additional embodiments of the present disclosure.
Figure 18:
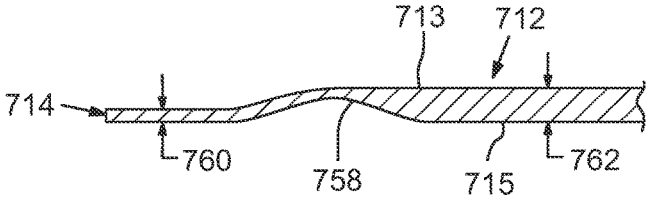
FIG. 18 is a section view of an area of the protective body of FIG. 17 that includes an edge.

Moreover, as shown in the embodiments of FIGS. 17 and 18, the thinned area 758 can be contoured. For instance, the thinned area 758 can be a contoured recess that recesses from the inner surface 715 of the body 712. Also, the thickness 760 of the body 712 adjacent the edge 714 can be less than the thickness 762 of the central portion of the body 712.

Thus, as shown in the embodiments of FIGS. 10-18, the thickness of the protective body can vary in the inboard-outboard direction of the body. As such, the body can have increased flexibility adjacent the respective edges.

Figure 19:
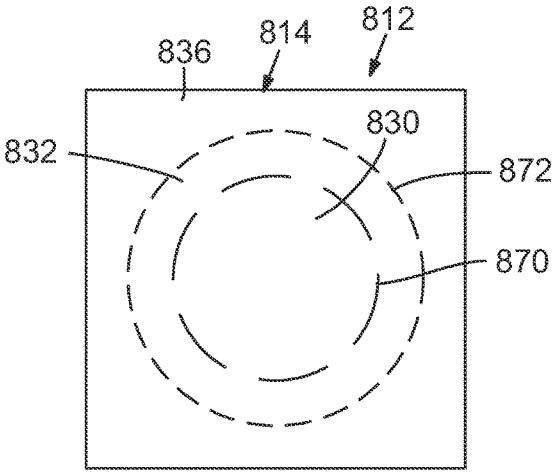
FIG. 19 is a front view of the protective body according to additional embodiments of the present disclosure.

Referring now to FIG. 19, the protective body 812 is shown according to additional embodiments. Components that correspond to the embodiments of FIGS. 1-5 are indicated with corresponding reference numbers increased by 800.

The body 812 can include a plurality of regions of varying shape, flexibility, stiffness, flexural modulus, modulus of elasticity, materials, and the like. For example, the first region 830 can be generally circular and can be substantially centered on the body 812 as indicated by the boundary line 870. The second region 832 can be annular and substantially centered about the first region 830 as indicated between the boundary line 870 and the boundary line 872. Furthermore, the third region 836 can be defined in the inboard direction by the substantially circular boundary line 872. Also, the third region 836 can be defined in the outboard direction by the peripheral edge 814. The first region 830 can have higher stiffness than the second region 832, and the second region 832 can have higher stiffness than the third region 836. Stated differently, the third region 836 can be more flexible than the second region 832, and the second region 832 can be more flexible than the first region 830. Accordingly, when the body 812 is impacted or otherwise loaded, the third region 836 can flex more easily than the other regions 830, 832 of the body 812 to reduce the likelihood of stress concentrations along the edge 814 against the wearer's body.

Now that the structural features of the body have been discussed above in relation to various embodiments, the material composition and manufacturing of the body will be discussed according to some embodiments. The materials and/or manufacturing methods used to form the body can be selected such that different regions exhibit different flexibilities. These concepts will be discussed with reference to FIGS. 20-29, and with reference to the body 12 shown in FIGS. 2-5. However, it will be appreciated that the following discussion about the materials of the body and the manufacturing of the body can apply to the embodiments of FIGS. 6-19 or to other embodiments of the body.

In some embodiments, the body can be at least partially made from one or more composite materials. The composite material(s) can include two or more different sub-components. Generally, the composite material(s) can include a matrix component and a reinforcement component that is distributed, suspended, or otherwise incorporated within the matrix component.

The matrix component and the reinforcement component can be of any suitable type. For example, the matrix component can be a polyester, vinyl ester, epoxy, nylon, or phonolic resin. Also, in some embodiments, the reinforcement component can include items of material formed in various shapes. For example, the items of material of the reinforcement component can be formed as fibers, spheroids, or other shapes. The items of material can be substantially shaped the same in some embodiments. In other embodiments, the items of material can be relatively small particles of various shapes. The reinforcement component can also be made from carbon, aramid, glass, or other materials. Also, the matrix and reinforcement components can cure together in a curing reaction that is initiated by the application of heat, pressure, or via a chemical reaction (e.g., via exposure to an organic peroxide). Additionally, polymeric molecules within the composite can bond through cross-linking processes during the curing stage. This chemical reaction results in a strong highly cross-linked molecular structure.

Additionally, the body can be formed using any suitable manufacturing technique. For example, the body can be formed using a molding and/or forging process. For example, the body can be compression molded composite or a forged composite. In the case of a forged composite, the material used to form the body can be a commercially available material produced by Quantum Composites of Bay City, Mich. in the United States of America.

Figure 21:
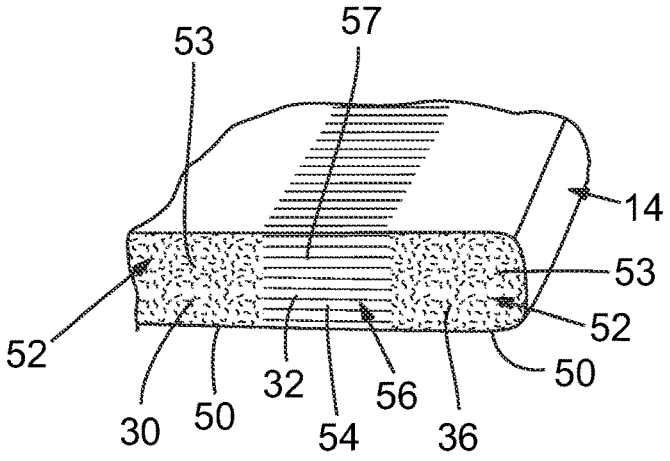
FIG. 21 is a section view of the protective body taken along the line 21-21 of FIG. 20.

In the embodiment of FIG. 21, for example, the first region 30 and the third region 36 can include substantially the same materials, namely a matrix component 50 and a reinforcement component 52. The second region 32 can also include a matrix component 54 and a reinforcement component 56. The reinforcement component 52 and the reinforcement component 56 can include a plurality of items. These items can be shaped as randomly shaped particles, fibers, chips, spheroids, or other shapes.

In some embodiments, the matrix component 50 can be substantially the same material as the matrix component 54. Stated differently, the matrix component 50 and the matrix component 54 can include a matrix material that is common to the first region 30, the second region 32, and the third region 36. In other embodiments, the matrix component 50 can be a different material from the matrix component 54. Also, the matrix component 50 and/or the matrix material 54 can be an epoxy, a thermoplastic resin, or other suitable material.

Also, in some embodiments, the reinforcement component 52 can be made from substantially the same material as the reinforcement component 56. In other embodiments, the reinforcement component 52 can be made from a different material from the reinforcement components 56. For example, in some embodiments, the reinforcement component 52 and the reinforcement component 56 can made from carbon, aramid, glass, or other suitable materials.

However, the size, shape, and arrangement of the items comprising the reinforcement component 52 can be different from that of the reinforcement component 56. The size, shape, and arrangement of these components can affect the relative flexibilities of the first region 30, second region 32, and third region 36.

For example, in some embodiments the reinforcement component 56 of the second region 32 can include a plurality of relatively long fibers 57 that are suspended within the matrix component 54. These fibers 57 can be disposed in a predetermined arrangement. In contrast, as shown in FIG. 21, the reinforcement component 52 of the first region 30 and the third region 36 can include a plurality of relatively small, short, microscopic particles 53 that are suspended within the matrix component 50. The particles 53 can be randomly shaped such that some of the particles 53 have one shape and others of the particles 53 have a different shape. Moreover, the particles 53 can be turbostratic in some embodiments such that the atoms making up the particles 53 are haphazardly folded, or crumpled, together. The particles 53 can be oriented in a variety of directions within the matrix component 50. These particles 53 can be disposed in a substantially random, non-uniform, and uneven arrangement. Also, the particles 53 can be intertwined with each other in some embodiments. This arrangement of the particles 53 can enhance the strength, stiffness, or other characteristic of the first region 30 and the third region 36.

Figure 20:
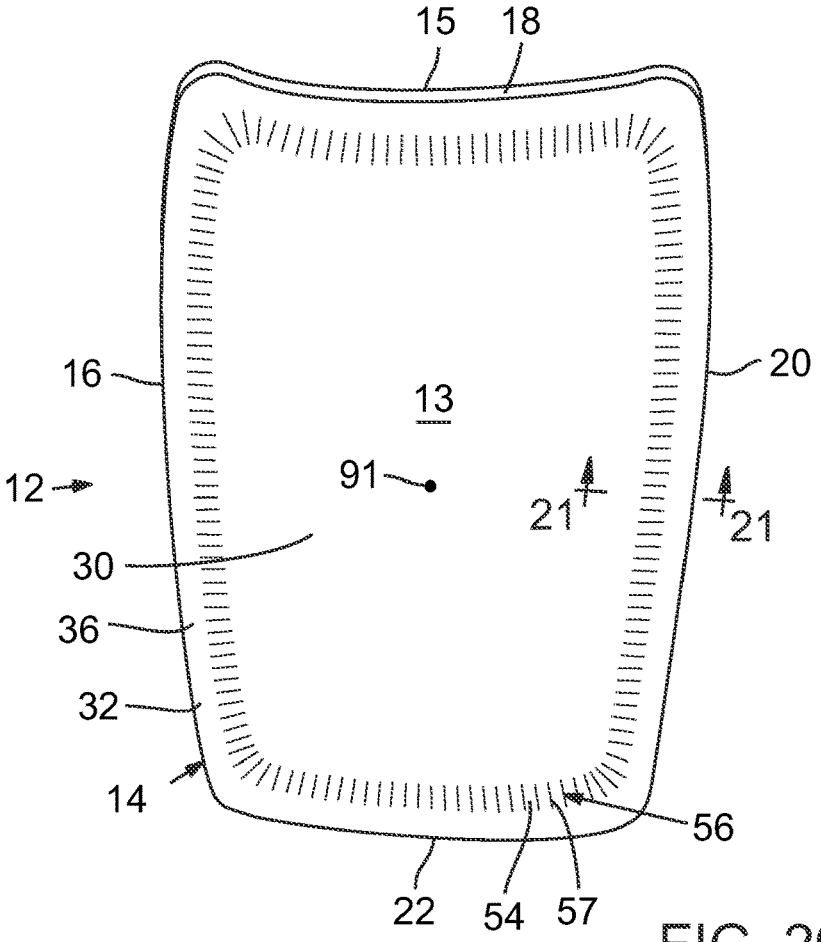
FIG. 20 is a front view of the protective body of FIG. 2 illustrating additional features.

In some embodiments, the fibers 57 of the second region 32 can be oriented along a load path that promotes flexibility of the second region 32. More specifically, as shown in the embodiment of FIGS. 20 and 21, the fibers 57 can be substantially uni-directional and the fibers 57 can be arranged in a substantially common direction. For example, the fibers 57 can extend transverse to the edge 14 such that the longitudinal axis of the fibers 57 intersects the edge 14. Also, in some embodiments, the fibers 57 can extend substantially normal to the edge 14. With this arrangement, the fibers 57 can bend slightly as the edge 14 flexes as shown in FIG. 5. This arrangement can be substantially constant in the peripheral direction along the edge 14 of the body 12 as shown in FIG. 20 such that the fibers 57 substantially radiate from the center 91 of the body 12 toward the edge 14. Additionally, as shown in FIG. 21, the fibers 57 can overlay each other and can extend transverse to the edge 14 throughout the thickness of the body 12. Moreover, in some embodiments, the fibers 57 can be spaced substantially evenly from each other within the second region 32.

It will be appreciated that the arrangement of the fibers 57 can vary from the embodiments shown in FIGS. 20 and 21. However, the fibers 57 of the second region 32 can be predetermined and arranged to provide the desired amount of flexibility. Thus, in some embodiments, at least some of the fibers 57 can extend along or generally parallel to the edge 14. Also, in some embodiments, the fibers 57 can be woven together such that different fibers 57 extend at different angles with respect to the edge 14.

Thus, the materials used to form the first region 30, the second region 32, and the third region 36 can be selected to provide those regions with the desired amount of flexibility. In the embodiment of FIGS. 20 and 21, for example, these materials allow the first region 30 to be relatively rigid and strong, and these materials allow the second region 32 to be more flexible. As such, when the body 12 is impacted as shown in FIGS. 4 and 5, the second region 32 can flex to allow the third region 36 to rotate relative to the first region 30.

It will be appreciated that, in other embodiments, the second region 32 can include the relatively short particles 53 while the first region 30 and the third region 36 can include the relatively long fibers 57. In these embodiments, the second region 32 can have a smaller thickness than the first region 30 and the third region 36 such that the second region 32 can be more flexible. For example, the second region 32 can include one or more recesses, pockets, grooves, or other thinned areas, similar to the embodiments of FIGS. 13-18.

In still other embodiments, the first region 30, the second region 32, and the third region 36 can include substantially the same materials. For example, these regions can include the same matrix material and the same type of small, randomly arranged particles 53 distributed throughout. In these embodiments, the edge 14 of the body can include recesses, pockets, grooves, or other thinned areas that promote flexibility of the edge 14.

Referring now to FIGS. 22-29, a method of manufacturing the body 12 is illustrated according to exemplary embodiments. Although the method is illustrated with respect to the body 12 of FIGS. 1-5, 20, and 21, it will be appreciated that the illustrated method can be modified for making the protective bodies illustrated in FIGS. 6-19 as well without departing from the scope of the present disclosure.

The body 12 can be made using any suitable manufacturing technique. For example, the body 12 can be at least partially made via compression molding techniques using a mold assembly 1000.

In some embodiments, the second region 32 of the body 12 can be formed independently, and then inserted into the mold assembly 1000. The materials of the first region 30 and the third region 36 can then be molded (e.g., compression molded) around the second region 32, resulting in the one-piece, monolithic body 12 shown in FIGS. 2, 20, and 21. In additional embodiments, the first, second, and third regions 30, 32, 36 can be co-molded and formed substantially simultaneously, resulting in a monolithic, one-piece body 12.

Moreover, in some embodiments, the first region 30, second region 32, and/or third region 36 can be formed as a forged composite. Thus, a plurality of solid pellets, chips, or particles of composite material can be placed in the mold cavity. Heat and pressure can be applied to join and fuse the particles together to form the body 12. Also, in some embodiments, some of the regions 30, 32, 36 of the body 12 can be formed as a forged composite, while other regions can be formed differently.

Figure 22:
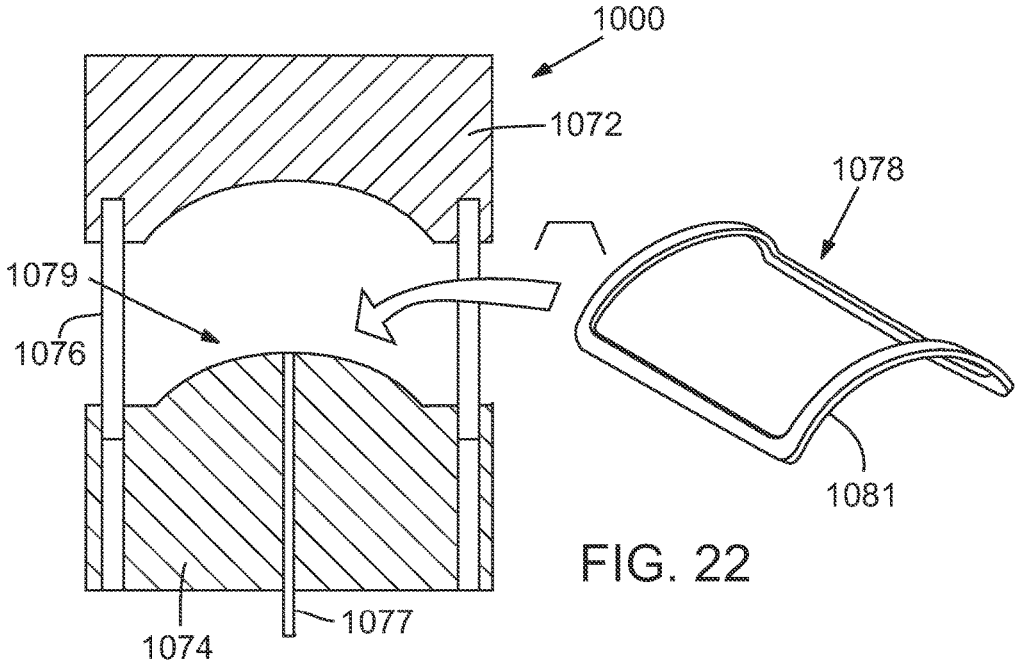
FIG. 22 is a schematic view of a method of manufacturing the protective body according to exemplary embodiments.

As shown in FIG. 22, the mold assembly 1000 can include a first mold member 1072 and a second mold member 1074. The first and second mold members 1072, 1074 can be attached and aligned via a jig 1076. A mold cavity 1079 can be defined between opposing surfaces of the mold members

1072, 1074. The mold assembly can also include an ejector pin 1077 used for ejecting the body 12 after the body 12 has been formed.

Figure 23:
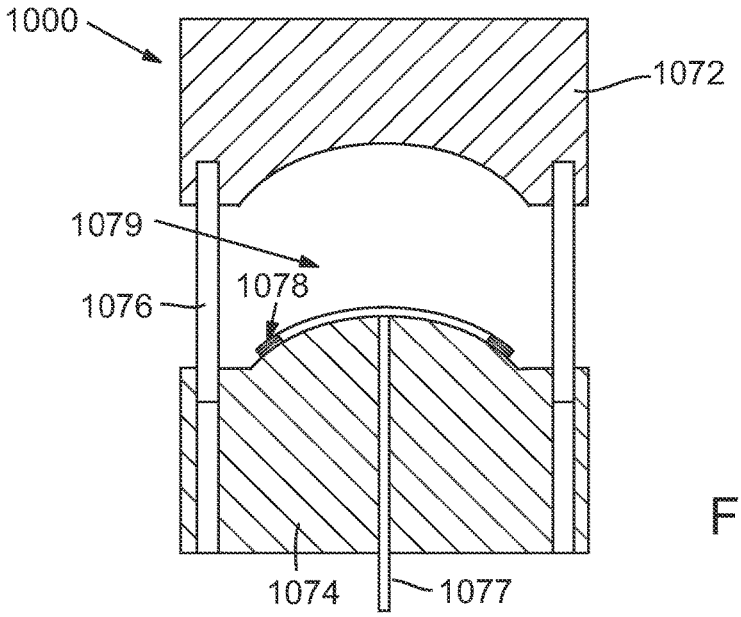
FIG. 23 is a schematic view of the method of manufacturing showing an event that is subsequent to FIG. 22 according to exemplary embodiments.

In some embodiments, a preform 1078 (i.e., pre-preg or mat) can be used to form the body 12 as shown in FIG. 22. The preform 1078 can be a solid object formed substantially of the same material as the second region 32 of the body 12. Thus, in some embodiments, the preform 1078 can include the matrix component 54 as well as the relatively long, uniformly arranged fibers 57 described above. The preform 1078 can also have a shape corresponding to the second region 32 of the body 12. Thus, the preform 1078 can have a frame-like shape. As shown in FIG. 23, the preform 1078 can be inserted into the mold cavity 1079 and positioned atop the second mold member 1074. The fibers 57 can be positioned within the preform 1078 with respect to the mold cavity 1079 such that the fibers 57 do not move substantially during the molding process. For example, the fibers 57 can be disposed as discussed above with respect to FIG. 21.

Figure 24:
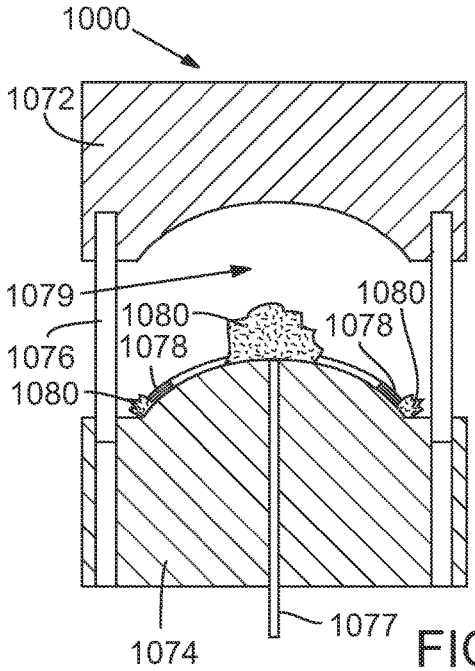
FIG. 24 is a schematic view of the method of manufacturing showing an event that is subsequent to FIG. 23 according to exemplary embodiments.

Next, as shown in FIG. 24, a charge 1080 of material can be inserted into the mold cavity 1079. The charge 1080 can include substantially the same materials as the first region 30 and the third region 36 of the body 12. Thus, the charge 1080 can include the matrix component 50 and the relatively short, randomly arranged particles 53 described above.

Figure 25:
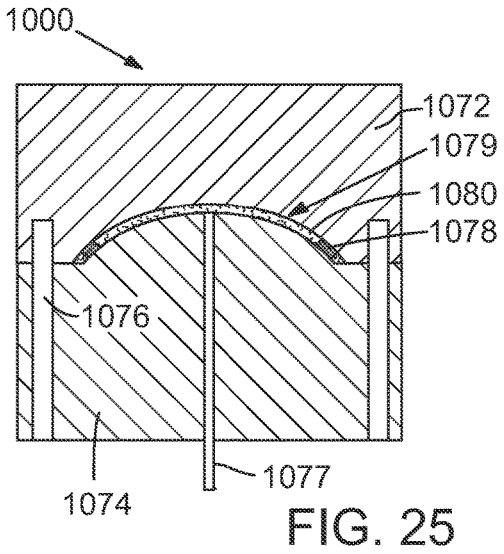
FIG. 25 is a schematic view of the method of manufacturing showing an event that is subsequent to FIG. 24 according to exemplary embodiments.
Figure 27:
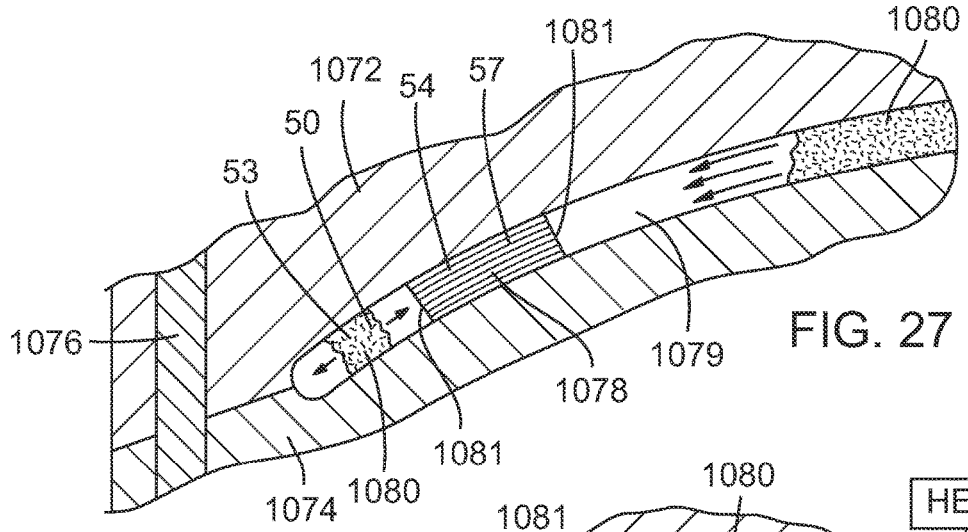
FIG. 27 is a detail view of a portion of a mold used in the manufacturing method of FIGS. 22-26 showing the molding process at an initial stage.

Then, as shown in FIG. 25, the first and second mold members 1072, 1074 can move toward each other to close the mold cavity 1079. As shown in FIG. 27, this can cause the material of the charge 1080 to substantially fill in empty space within the mold cavity 1079. Also, the material of the charge 1080 can move into abutment with exposed surfaces 1081 of the preform 1078.

Figure 28:
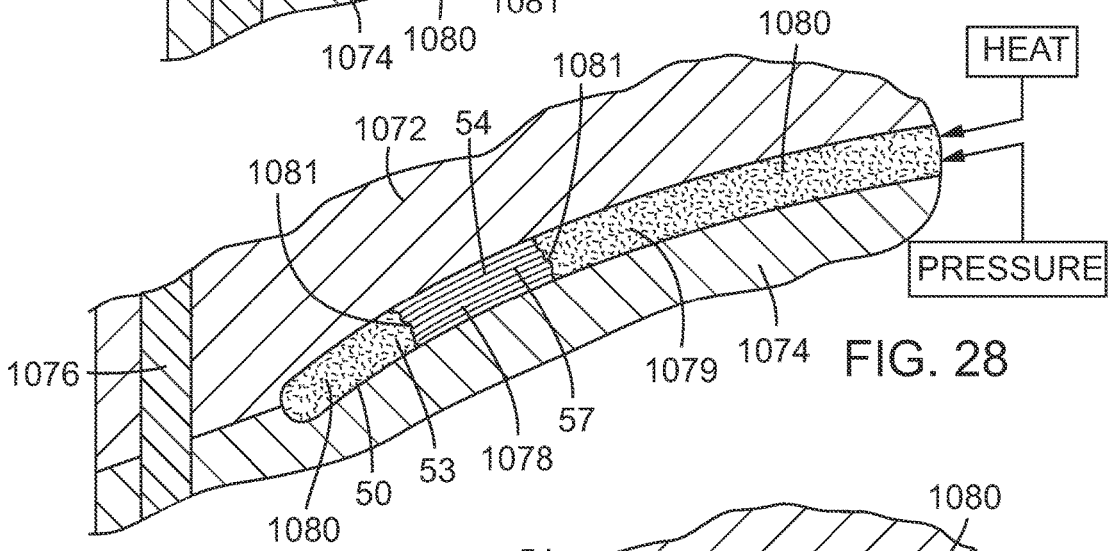
FIG. 28 is a detail view of the portion of the mold of FIG. 27 showing the molding process at a later stage.

Subsequently, as shown in FIG. 28, heat and pressure can be applied to the mold assembly and the materials within the mold cavity 1079. More specifically, the mold members 1072, 1074 can be heated, and this heat can transfer to the materials of the preform 1078 and the charges 1080. Additionally, the mold members 1072, 1074 can apply pressure to these materials. In some embodiments, the mold members 1072, 1074 can be heated to approximately 900 F at approximately 1000 pounds of pressure. As a result, the matrix component 50 and the matrix component 54 can at least partially liquefy and can meld, intermix, or otherwise combine together. This is represented schematically in FIG. 28 because the surfaces 1081 of the preform 1078 have become wavy.

Figure 26:
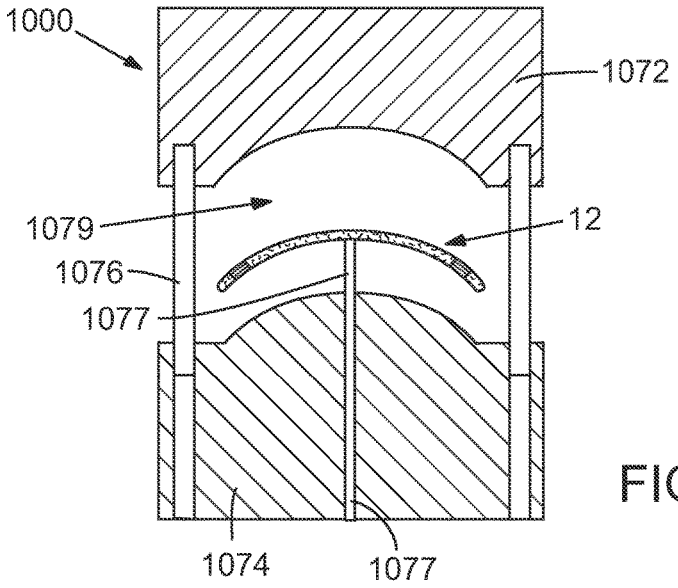
FIG. 26 is a schematic view of the method of manufacturing showing an event that is subsequent to FIG. 24 according to exemplary embodiments.
Figure 29:
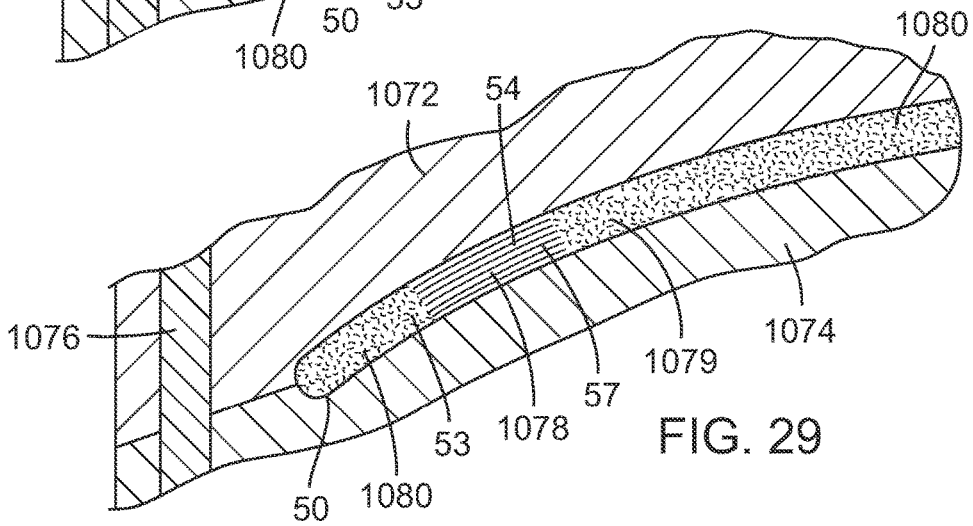
FIG. 29 is a detail view of the portion of the mold of FIG. 28 showing the molding process at a later stage.

Then, as shown in FIG. 29, the materials can cure within the mold cavity. In some embodiments, the materials can cure for approximately ten seconds. The materials of the charge 1080 and the preform 1078 can further join together. For example, the matrix component 50 and the matrix component 54 can cure together, leaving the particles 53 and fibers 57 in the arrangement discussed above. Once cured, the one-piece body 12 can be removed from the mold cavity 1079 by the ejector pin 1077 as shown in FIG. 26.

Accordingly, the body 12 can be formed in an efficient manner. The body 12 can be formed in a relatively short amount of time with relatively little waste. Also, the body 12 can be formed repeatedly within relatively small tolerances.

In summary, the body of the article of protective equipment can provide effective protection for the wearer. The body can be a one-piece member that is very strong, durable, and lightweight. The body can also be shaped to conform closely to the wearer's body. Thus, the body can be comfortable to wear. The body can also include one or more predetermined regions that have increased flexibility relative to other regions. For example, the edges of the body can flex when the body is impacted such that stress concentrations at the edge are unlikely. Moreover, the body can be manufactured efficiently. The body can be made in a relatively short amount of time. Also, there are relatively few parts necessary to form the article of protective equipment. Moreover, in some embodiments, the body can provide adequate protection for the wearer without having to include extra pads, bladders, or other parts.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Moreover, various features of the embodiments disclosed herein can be combined in ways other than those shown in the illustrations. Also, various modifications and changes may be made within the scope of the attached claims.

What is claimed is:

1. An article of protective equipment configured to protect a wearer, the article comprising:

a one-layer body that includes:

a first region formed from a first composite material having a first resin and at least one of a first particle, wherein the at least one of the first particle is embedded in the first resin in a first orientation;

an edge; and a second region that extends between the first region and the edge, wherein the second region encompasses the first region, wherein the second region is formed from a second composite material having a second resin and at least one of a second particle, wherein the at least one of the second particle is embedded in the second resin in a second orientation that is different than the first orientation;

the body being configured to protect the wearer from an input load, and the second region configured to flex under the influence of the input load to allow the edge to move relative to the first region, wherein the first region forms a perimeter around the second region of the article of protective equipment.

2. The article of protective equipment of claim 1, wherein the body includes an inner surface configured to face toward the wearer, wherein the body further includes an outer surface configured to face away from the wearer, wherein the edge extends between the outer surface and the inner surface, and wherein the edge at least partially defines an outer perimeter of the body.

3. The article of protective equipment of claim 1, wherein the body includes an inner surface configured to face toward the wearer when the body is worn by the wearer, wherein the body further includes an outer surface configured to face away from the wearer when the body is worn by the wearer; and wherein the body includes a through-hole extending from the outer surface to the inner surface, and wherein the edge is an inner edge that at least partially defines the through-hole.

4. The article of protective equipment of claim 1, wherein the at least one of the second particle includes fibers, and wherein at least some of the fibers are arranged transverse to the edge.

5. The article of protective equipment of claim 4, wherein at least some of the fibers are arranged perpendicular to the edge.

6. The article of protective equipment of claim 1, wherein the first resin and the second resin are the same resin.

7. The article of protective equipment of claim 1, wherein the body further includes a third region that defines the edge, wherein the second region is spaced in an inboard direction relative to the edge, wherein the first region and the third region include at least one of the first particle in the first orientation, wherein the second region includes at least one of the second particle in the second orientation, and wherein the second region acts as a hinge between the first region and the third region.

8. The article of protective equipment of claim 1, wherein the body includes an inner surface configured to face toward the wearer when the body is worn by the wearer, wherein the body further includes an outer surface configured to face away from the wearer when the body is worn by the wearer, wherein the body has a cross section taken from the inner surface to the outer surface, wherein the at least one of the second particle includes fibers arranged in a common direction within the cross section, and wherein the fibers are evenly spaced from each other within the cross section.

9. The article of protective equipment of claim 1, wherein the second region defines the edge.

10. The article of protective equipment of claim 1, wherein the first region has a first thickness and the second region has a second thickness, and wherein the second thickness is less than the first thickness.

11. The article of protective equipment of claim 1, wherein the body tapers down in thickness from the first region to the edge.

12. The article of protective equipment of claim 1, wherein the body has a thickness, wherein the thickness of the body is constant in an inboard direction within a distance of approximately 1.5 inches from the edge; and wherein the thickness is constant in a peripheral direction, wherein the peripheral direction extends about a periphery of the body along the edge.

13. An article of protective equipment configured to protect a wearer, the article comprising:

a one-layer body that is monolithic and that includes:

a first region co-molded with a second region, the first region formed from a first composite material having a first resin and at least one of a first particle wherein the at least one of the first particle is embedded in the first resin;

an edge; and the second region that extends between the first region and the edge, the second region formed from a second composite material having a second resin and at least one of a second particle wherein the at least one of the second particle is embedded in the second resin, and wherein the at least one of the first particle is embedded in the first resin in a more random arrangement than the at least one of the second particle is embedded in the second resin;

the body being configured to protect the wearer from an input load, and the second region configured to flex under the influence of the input load to allow the edge to move relative to the first region.

14. The article of protective equipment of claim 13, wherein the at least one of the first particle and the at least one of the second particle are a plurality of fibers, and wherein the plurality of fibers are arranged perpendicular to the edge.

* * * * *